US005113533A

United States Patent [19]

Takada

[11] Patent Number: 5,113,533

[45] Date of Patent: May 19, 1992

[54] ARM BAND

[76] Inventor: Toshiyuki Takada, 207 Yamanote, 2-chome, Meito-ku, Nagoya-shi, Aichi-ken, Japan

[21] Appl. No.: 639,552

[22] Filed: Jan. 10, 1991

[30] Foreign Application Priority Data

Oct. 16, 1990 [JP] Japan ..... 2-278554

[51] Int. Cl.[5] ..... A41D 13/00

[52] U.S. Cl. ..... 2/170; 2/1; 2/16; 2/59

[58] Field of Search ..... 2/1, 2, 16, 59, 160, 2/162, 170, 244

[56] References Cited

U.S. PATENT DOCUMENTS

| | | | |
|---|---|---|---|
| 241,224 | 5/1881 | Kleinert | 2/170 |
| 856,282 | 6/1907 | Moss | 2/170 |
| 1,153,893 | 9/1915 | Connie | 2/170 |
| 1,351,378 | 8/1920 | Frankel | 2/116 X |
| 2,082,574 | 6/1937 | Handley | 2/16 |
| 2,127,926 | 8/1938 | Mason | 2/170 |
| 2,249,550 | 7/1941 | Williams | 2/170 |
| 2,656,763 | 10/1953 | Frost | 2/59 X |
| 2,832,074 | 4/1958 | Wheeler | 2/16 |
| 3,189,919 | 6/1965 | Chase | 2/16 |
| 3,332,415 | 7/1967 | Ericson | 2/1 X |
| 4,068,318 | 1/1978 | McMahon | 2/170 |
| 4,576,668 | 3/1986 | Farrelly et al. | 2/244 X |
| 4,896,378 | 1/1990 | Campana | 2/16 X |
| 4,959,875 | 10/1990 | Moon | 2/16 X |

FOREIGN PATENT DOCUMENTS

| | | | |
|---|---|---|---|
| 2825525 | 1/1979 | Fed. Rep. of Germany | 2/16 |
| 152184 | 10/1985 | Japan . | |

*Primary Examiner*—Werner H. Schroeder
*Assistant Examiner*—Jeanette E. Chapman
*Attorney, Agent, or Firm*—Heller, Ehrman, White & McAuliffe

[57] ABSTRACT

A split ring arm band is provided that is both easy to put on and maintains good resiliency. The arm band includes a split ring band having interior and exterior surfaces and a plurality of ribs for reinforcing the resiliency of the band. The arm band may also have a contact surface for engaging a wearers arm when the arm band is put on. The contact surface may take the form of lip extending outward from a first end of the band. Alternatively, the band can be formed in a spiral manner to provide the contact surface at the end of the band.

20 Claims, 4 Drawing Sheets

ARM BAND

BACKGROUND OF THE INVENTION

1. Field of the Invention

The present invention relates generally to arm bands. More particularly, a resilient unsized arm band construction is described.

2. Description of the Related Art

Arm bands are worn by a wide variety of people for an even wider variety of reasons. At times they are worn as fashion, but more often they are worn as identification. Common users include safety personnel (such as policemen, firemen and medical personnel) people directing traffic and staff in events likely to attract large numbers of people. Of course they may be worn for a wide variety of other reasons as well. Often, one of the objectives of the arm band is to make the wearer highly visible and identifiable. Therefore, many arm bands are bright colors and/or have reflective surfaces to enhance the wearers visibility.

A wide variety of arm band designs have been used in the past. For example, the arm band may be stitched onto clothing. Others are made of cloth or plastic materials and are pinned or tied to the wearers clothing. Unfortunately, such devices are somewhat cumbersome and require that the user be wearing a sleeved shirt. Still others are formed as elastic bands that are slid over the hand to a resting position on the arm. One problem with such devices is that they tend to slip from the wearers arm and often one size does not fit a very wide range of people.

In Japanese laid open patent publication No. 60-152184 the present inventor described several split ring style plastic arm band designs. A representative design is shown in FIG. 18. As seen therein, the slip ring arm band 100 has a plastic base 105 formed in a substantially cylindrical shape. Lips 110 may be formed on the opposing ends of the base and a gap 112 is formed therebetween. Several gripping arrangements are also described. It has been discovered that in use, (and particularly during extended uses) arm bands made in such a manner tend to loose their resiliency and thus may eventually slide down the wearers arm. The present invention is an improvement on these designs intended primarily to improve the bands resiliency.

SUMMARY OF THE INVENTION

Accordingly, it is a primary objective of the present invention to provide an improved resiliency split band style arm band. It is also an objective of the invention to provide an arm band that is very easy to put on.

To achieve the foregoing and other objects and in accordance with the purpose of the present invention, a split ring arm band is provided that is both easy to put on and maintains good resiliency. The arm band includes a split ring band having interior and exterior surfaces and at least one rib for reinforcing the resiliency of the band.

In a preferred embodiment, it is contemplated that a plurality of ribs will be provided with at least one outer rib protruding outward from the band and at least one inner rib protruding inward from the interior surface of the band. The inner rib also prevents slippage when the arm band is worn.

In a preferred embodiment, the arm band also has a contact surface for engaging a wearers arm when the band is put on. The contact surface may take the form of lip extending outward from a first end of the band. Alternatively, the band can be formed in a spiral manner to provide the contact surface at the end of the band.

In another preferred embodiment, a pair of outer ribs are provided with the outer ribs being disposed on opposite sides of the band.

BRIEF DESCRIPTION OF THE DRAWINGS

The features of the present invention that are believed to be novel are set forth with particularity in the appended claims. The invention, together with the objects and advantages thereof, may best be understood by reference to the following description of the presently preferred embodiments together with the accompanying drawings in which:

DETAILED DESCRIPTION OF THE PREFERRED EMBODIMENTS

Figure 1:
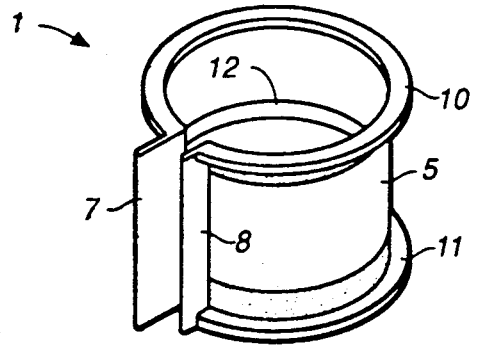
FIG. 1 is a perspective view of an arm band in accordance with the present invention.
Figure 2:
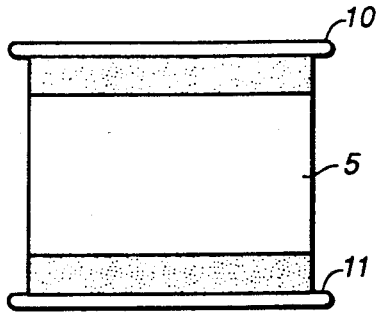
FIG. 2 is a front view of the arm band shown in FIG. 1.

As illustrated in the drawings, a preferred embodiment of the arm band includes one or more ribs that provide structural support and resiliency for the arm band. Referring initially to FIGS. 1-7, the first described embodiment of the arm band 1 has a substantially cylindrical split ring band 5, a pair of lips 7,8 and a plurality of ribs 10-12.

The band 5 has a plurality of ribs 10-12 to improve its resiliency. As best seen in FIGS. and 7, the first described embodiment has a pair of outer ribs 10 and 11 located on opposite sides of the band 5 and a central inner rib 12. As used herein, the term "inner rib" is intended to signify a rib that extend inward from the interior surface of the band 5 towards the wearers arm in use. Similarly, the term "outer rib" is intended to represent ribs that extend outward from the exterior surface of the band 5 away from a wearers arm in use. The primary purpose of the ribs is to lend structural support to the band 5 in order to provide good resiliency. The inner rib 12 also helps prevent the arm band from slipping down the wearers arm by providing a friction surface. This Is particularly useful if the arm band is worn by a person having a small arm.

The friction surface can be formed in a wide variety of ways as will be described in more detail below. Although it should be appreciated that the actual dimensions of the various band will vary widely depending upon the actual materials used, in the embodiment shown in the FIGS. 1-7, the inner rib 12 has a substantially rectangular cross section and has a height above the interior surface of band 5 in the range of 0.5-3 mm. Its width is in the range of 5 to 10 mm. The raised edge of the inner rib 12, thus forms the friction surface during use. The height of the rib is relatively low so that the arm band is not uncomfortable when it is worn.

The outer ribs, as well as all of the remaining edges in the arm band are rounded so that no sharp edges are present which could inadvertently cut or otherwise injure the wearer.

Figure 6:
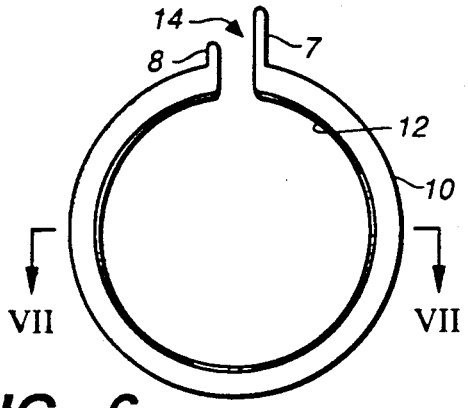
FIG. 6 is a top view of the arm band shown in FIG. 1.
Figure 3:
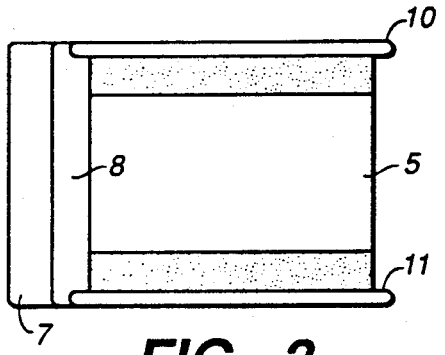
FIG. 3 is a left side view of the arm band shown in FIG. 1.

The lips 7 and 8 are formed on the opposing ends of the split ring band 5 and extend outward therefrom. Thus, the lips 7 and 8 face one another and form a gap 14 therebetween. As best seen in FIGS. 1 and 6, the lip 7 is substantially longer than lip 8. This is to allow the wearer to quickly and easily put the arm band on using only one hand. Specifically, to put on the arm band 1, the wearer places lip 7 against his or her arm while holding the portion of the band 5 near the end carrying lip 8. The lip 7 then anchors the arm band as the user pulls on the free end. This separates the lips and allows the band to be easily slipped onto the wearers arm. Since the ribs 10-12 provide good resiliency, the band will quickly clamp around the wearers arm when tension is released after the arm band 1 has been put on. Although the size of the lips may be widely varied, in the embodiment chosen for illustration lip 7 is in the range of 1-2 centimeters and lip 8 in approximately half the length of lip 7.

The described arm band 1 may be fabricated in a wide variety of manners. One preferred method of fabrication is by injection molding a resilient plastic material to create an integral plastic arm band. With the described construction, the band 5 can be quite thin since the ribs 10-12 provide good resiliency. It should be appreciated that a wide variety of other materials may be used to form the arm band as well.

Figure 10:
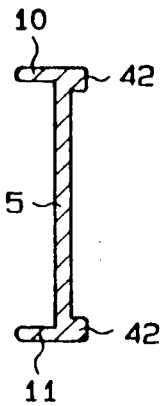
FIG. 10 is a vertical cross sectional view of an arm band having yet another rib arrangement.
Figure 9:
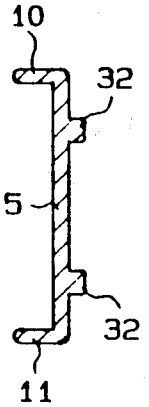
FIG. 9 is a vertical cross sectional view of an arm band having a third rib arrangement.
Figure 8:
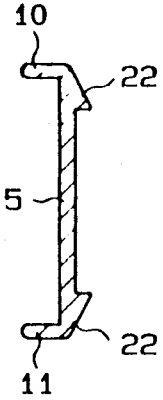
FIG. 8 is a vertical cross sectional view of an arm band having an alternative rib arrangement

Referring next to FIG. 8-12 several alternative rib arrangements will be described. As seen in FIGS. therein, the location, geometry and number of the ribs may be varied. FIG. 8 shows a band having a pair of tapered inner ribs 22 positioned at opposite sides of the band substantially opposite the outer ribs 10 and 11. FIG. 9 has a pair of spaced apart substantially rectangular inner ribs 82 positioned between the outer ribs 10 and 11. FIG. 10 shows a construction having a pair of substantially rectangular inner ribs 42 positioned at the sides of the band 5 opposite the outer ribs 10 and 11.

Figure 12:
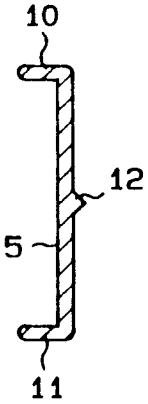
FIG. 12 is a vertical cross sectional view of an arm band having a V-shaped inner rib.
Figure 11:
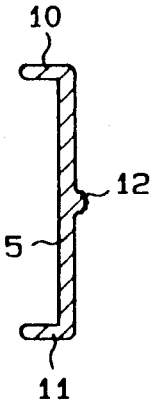
FIG. 11 is a vertical cross sectional view of an arm band having an knurled inner rib.
Figure 7:
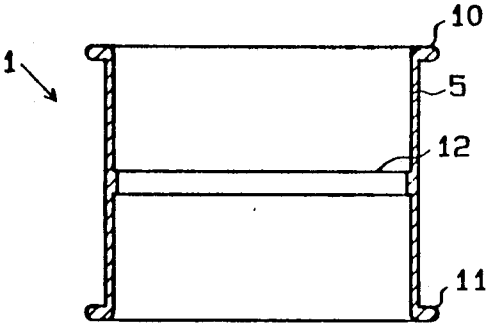
FIG. 7 is a vertical cross sectional view of the arm band shown in FIG. 6 taken along line VII—VII.
Figure 18:
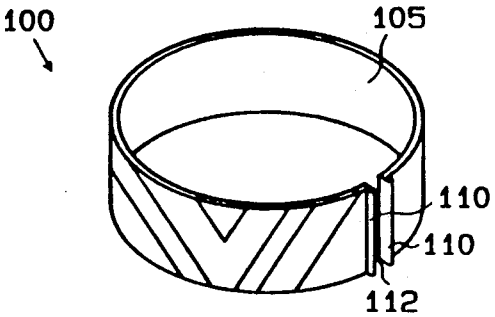
FIG. 18 is a perspective view of a prior art arm band.

Referring next to FIGS. 11 and 12, it should be appreciated that the geometry of the ribs may be widely varied. As indicated above, a second function of the inner rib is to prevent the band from sliding down the wearers arm. Thus, as seen in FIG. 11, the surface of the inner rib may be knurled to improve its gripping ability. FIG. 12 shows yet another construction which utilizes a V-shaped inner rib to provide an internal friction surface.

Although the embodiments shown in the drawings have the outer ribs located at the opposite sides of the band 5, this is not a requirement. Rather, the ribs may be located at any position on the exterior surface of the band 5. It should also be appreciated that the number of ribs could also be reduced.

One advantage of the fully spaced apart outer ribs is that a relatively large label 17 may be applied to the exterior surface of the band. The labels may identify the wearer as a safety officer such as first aid official, policeman or fireman. Alternatively they could identify staff or membership in a group. Alternatively, they could be day glow colors and/or reflective in order to make the user visible to traffic. Such labels would be particularly useful for pedestrian, bicyclists and motorists at the scene of an accident or other interruption of traffic. Of course the type of labels used can vary widely in accordance with the purpose of the arm band. By way of example, the label could be formed from paper, fabric or a plastic film. Alternatively, incombustible materials such as ceramics, carbon or glass fibers could be used as well. Such labels would permit firemen to safely use the arm band around fires.

It is also contemplated that the ribs and the band need not be fabricated from the same material. Indeed, the ribs 10-12 could be fabricated from a resilient material while the band 5 is not. By way of example, wood, rubber, and piano wire could all be as the resilient material, while cloth, paper, rubber, soft plastic and leather could all be used as the band 5.

Figure 14:
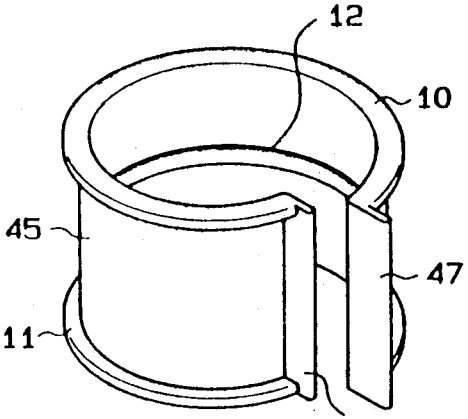
FIG. 14 is a perspective view of the arm band shown in FIG. 13.
Figure 13:
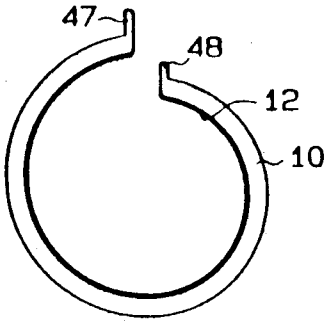
FIG. 13 is a top view of an alternative arm band embodiment having a spiral construction and small lips.

In the previous described embodiment, the lips 7 and 8 provide some structural support. However, the primary purpose of lip 8 is to provide an engaging surface to facilitate putting the arm band on. An equivalent function can also be facilitated in another way which will be described referring to FIGS. 13 and 14. As seen therein, the arm band 45 is formed as substantially one turn of a spiral. Both lips 47 and 48 are substantially reduced. However, since the band is formed as a spiral, the reduced lip 48 can still very effectively engage the wearers arm for easy installation. In other manners, the arm band may be formed as described above.

Figure 16:
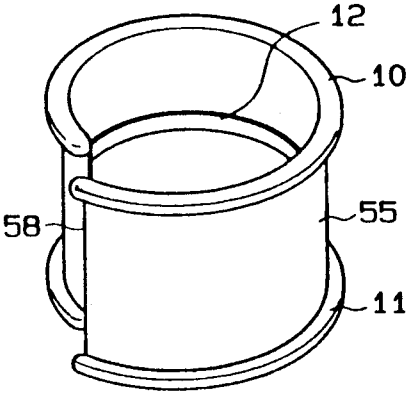
FIG. 16 is a perspective view of the arm band shown in FIG. 15.
Figure 15:
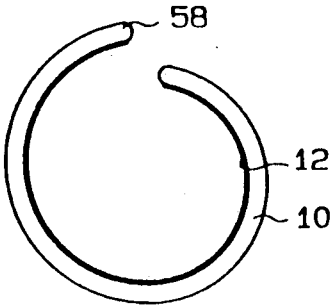
FIG. 15 is a top view of a spiral type arm band that does not have any lips.

FIGS. 15 and 16 show yet another embodiment, wherein the lips have been completely removed. Again, band 55 is formed as a spiral. In this embodiment, the end of the spiral 58 is pressed against the wearer's arm when the band is put on. It is noted that the amount of spiral may be varied somewhat. The more the band is wound, the stronger its resilience will typically be and the wider the variety of arm sizes that can be accommodated.

Figure 19:
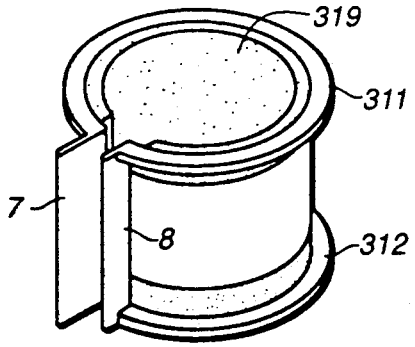
FIG. 19 is a perspective view of another embodiment of the arm band.
Figure 4:
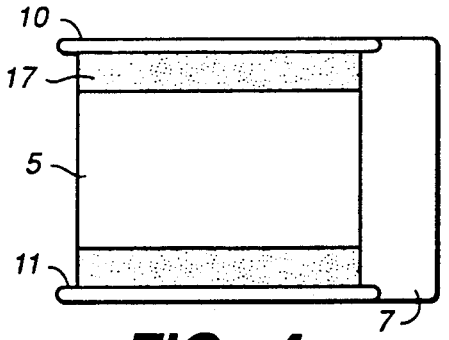
FIG. 4 is a right side view of the arm band shown in FIG. 1.

Another embodiment of the invention is shown in FIG. 19. As seen therein, the inner rib has been eliminated. When the inner rib is relatively sharp as in the first described embodiments, there is a tendency for a slight recess to form opposite the inner rib. The recess does not detract from the function of the arm band in any way. However, if a label 17 is directly applied to the outer surface of the band, then the recess makes it more difficult to apply the label Without forming any wrinkles in the label. Therefore, it is occasionally desirable to eliminate the inner rib altogether.

When the inner rib is removed, it will typically be desirable to increase the size of the outer ribs in order to provide the desired spring force. In all other respects, the band may be identical to any of those previously described.

To improve the comfort of the arm band, a foam material 319, such as a polyurethane foam, is adhered to the inner surface of the arm band. A foam material that breaths well is preferably selected so that the arm band does not cause the wearers arm to sweat. This improves the comfort of the arm band. The foam material serves two other purposes as well. That is, it forms a friction surface to prevent slippage. Since a relatively thick and spongy foam layer may be provided, it also improves the range of arm sizes that can wear the band.

Figure 23:
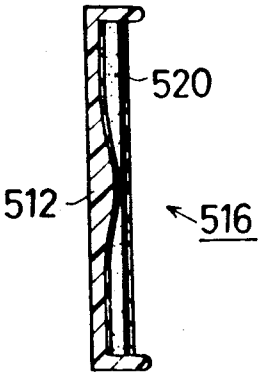
FIG. 23 is a vertical sectional view of the arm band shown in FIG. 21.
Figure 21:
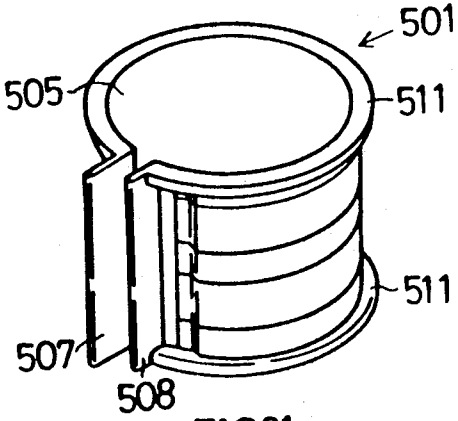
FIG. 21 is a perspective view of another embodiment of the invention.
Figure 22:
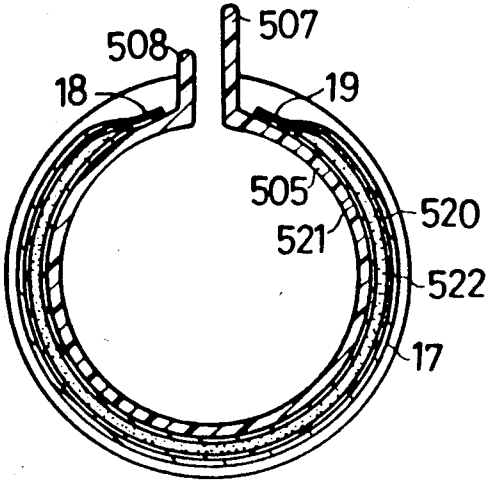
FIG. 22 is a horizontal sectional view of the arm band shown in FIG. 21.

Referring next to FIGS. 21-23, yet another embodiment of the invention will be described. In this embodiment, the arm band 501 has a pair of lips 507,508 and a pair of outer ribs 510,511 as previously described. Like the embodiment shown in FIG. 19, an inner rib is not used. However, as can best be seen in FIG. 23, a rounded central bulge 516 extends outward in between the outer ribs. The central bulge does not have the resilience of the rib structure. However, it is easier to manufacture by injection molding than the preceding embodiments.

When plastic is used as the band material and the arm band is made by injection molding, the central portion of the band is prone to deform somewhat. Therefore, if labels 17 are applied directly to the band, they often have a wrinkled appearance. They are also prone to becoming detached from the band after extended flexing. Therefore, in the embodiment shown, a foam material 520 is interposed between the label 17 and the exterior surface of the band. This makes it even easier to consistently apply nice looking labels to the arm band. Specifically, as seen in FIGS. 22 and 23, the foam material 520 is bonded to the exterior surface of band 505 by an adhesive 521. The label 17 is bonded to the foam material 520 by adhesive 522.

The opposing ends of the label 18 and 19 are bonded directly to the band 505 adjacent the lips 507,508. This helps keep the label securely attached to the band.

A wide variety of foam materials can be used to form foam layer 520. In the described embodiment, polystyrene is used. Appropriate polystyrene thicknesses are in the range 1 to 3 millimeters If the thickness is less than 1 millimeter, the foam does not have the desired leveling effect. On the other hand, if the thickness is much more than 3 millimeters, the label is prone to wrinkling. By way of example, in a specific described embodiment, a polystyrene foam having a density in the range of 0.02-0.024 g/cm$^3$ and having a thickness of 2 millimeters has been found to work well. Other suitable foams such as polyurethane may be used also. Alteratively soft fabrics such as cotton and non-woven fabric may be used as well. A wide variety of adhesives may be used. By way of example, acrylic resin works well.

In modifications of this embodiment, the label 17 may be eliminated altogether and the printing applied directly to the foam layer 520.

Figure 25:
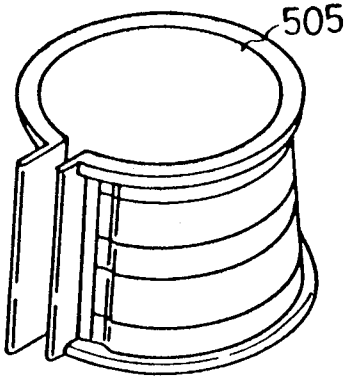
FIG. 25 is a perspective view of a modification of the embodiment shown in FIG. 21 wherein the band portion is tapered.

Another modification of this embodiment is shown in FIG. 25. As seen therein, the body portion of the band 505 has a frusto-conical shape. This shape is particularly well adapted to prevent slippage down the arm.

In still another modification, the body portion of the band may be made from a foam material having a higher density than the foam layer 520. By way of example, polystyrene having a density in the range of 0.05 to 0.07 g/cm$^3$ may be used.

Figure 20:
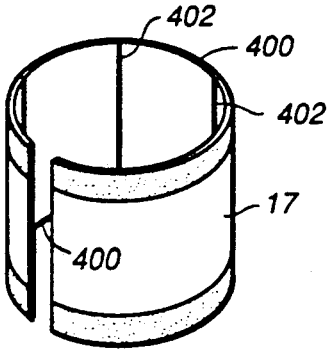
FIG. 20 is a perspective view of yet another embodiment of the invention.
Figure 5:
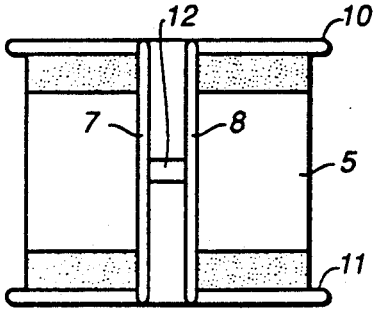
FIG. 5 is a rear view of the arm band shown in FIG.

Turning next to FIG. 20 yet another arm band structure will be described. In this embodiment, the ribs structure takes the form of a wire frame 400. Suitable wire, such as piano wire having good resilience is used. To reinforce the wire frame a plurality of wire cross ties 402 are used. The cross ties prevent the opposing sides of the wire frame from spreading unnaturally. A label 17 may then be applied directly to the wire frame.

Figure 17:
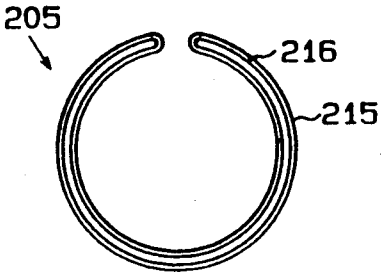
FIG. 17 is a top view of a ribless soft arm band having a film material to provided rigidity.

FIG. 17 show yet another arm band construction. As seen therein, the ribs have been replaced by a flexible internal support structure. In the embodiment shown, the band 205 has an outer jacket 215 that envelopes an inner material 216 that provide s support therefor. The band 205 is substantially cylindrical and is formed as a split ring.

The jacket is typically formed of a relatively soft and flexible material. By way of example, cloth, fabric, rubber and the like would all be suitable materials. The inner material 216 is typically formed from an elastomeric fill material such a polyethylene foam rubber or the like. It may also be filled with a fluid such as air or a liquid when the jacket forms a solid seal. Since this arm band design is relatively flexible it may be folded for storage in a compact form. However, when removed, the inner material 216 causes the band to resumes it original shape.

Since the band is quite resilient Vet flexible, it is not necessary to utilize the lips as in the first described embodiment. This is because when the surface of one end of the jacket is pressed against the wearers arm, it will stick in place well enough to put the arm band on in the manner previously described.

Figure 24:
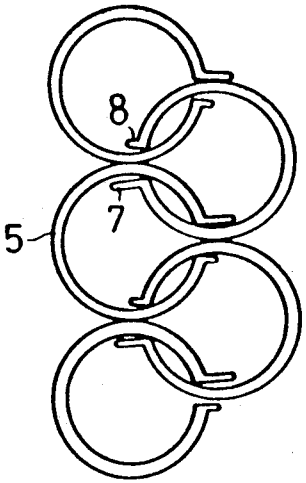
FIG. 24 is a top view showing a packaging arrangement for the split ring arm bands.

A method for packing the arm bands will be described with respect to FIG. 24. As seen therein, rigid arm bands can be packed in an interleaved manner. Thus, each of the central arm bands receives the ends adjacent arm bands through the slit defined between its lips 7 and 8. The width of the outer rims causes the lips to be slightly separated. Thus, the spring force of the band tends to help hold the bands together. The resultant arrangement is much more compact than packing the bands side by side, which saves costs in both packing and shipping.

Although only a few embodiments of the present invention has been described herein, it should be apparent to those skilled in the art that the present invention may be embodied in many other specific forms without departing from the spirit or scope of the invention. Particularly, it should be understood that the actual shapes and relative positions of the described ribs may be widely varied within the scope of the invention. Although the first embodiments of the invention were described using both inner and outer ribs, this is not always a requirement. Interior ribs may also be used. That is, ribs that are formed integrally with the band. It is also contemplated that in some embodiments, the ribs may be formed from different materials than the band they support.

The lips may also be widely varied in size and geometry. The lip need not extend the entire width of the band. Further, a single lip may be used. A wide variety of decorative features may be added to the exterior of the arm band. The colors chosen for the arm band and/or its labels can be readily chosen to suit any particular use. Additionally facades such as group emblems, humorous, contemporary or picturesque scenes and the like may all be applied to or integrally molded with the arm band. Therefore, the present examples and embodiments are to be considered as illustrative and not restrictive and the invention is not to be limited to the details given herein, but may be modified within the scope of the appended claims.

I claim:

1. An arm band comprising:

a split ring band having interior and outer surfaces; and a plurality of ribs for reinforcing the resiliency of the band, said ribs protruding from said band and including:

at least one outer rib protruding outward from the band for reinforcing the resiliency of the band; and at least one inner rib protruding inward from the interior surface of the band for reinforcing the resiliency of the band and preventing slippage when the arm band is worn.

2. An arm band as recited in claim 1 further comprising a first lip extending outward from a first end of the band.

3. An arm band as recited in claim 1 wherein said band is substantially cylindrical.

4. An arm band as recited in claim 1 wherein said band is formed in a spiral manner.

5. An arm band as recited in claim 1 wherein said inner rib has a substantially rectangular cross section.

6. An arm band as recited in claim 1 wherein said ribs include a pair of outer ribs protruding outward from the band for reinforcing the resiliency of the band, said outer ribs being disposed on opposite sides of the band.

7. An arm band as recited in claim 1 further comprising a second inner rib and a second outer rib, said inner ribs being positioned substantially opposite said outer ribs.

8. An arm band as recited in claim 1 wherein said inner rib has a roughened surface to enhance the slide resistance of the arm band.

9. An arm band as recited in claim 1 wherein said inner rib is V-shaped.

10. An arm band comprising:

a split ring band having interior and outer surfaces; and a plurality of ribs for reinforcing the resiliency of the band, said ribs protruding from said band, said ribs including: a pair of outer ribs protruding outward from the band for reinforcing the resiliency of the band, said outer ribs being disposed on opposite sides of the band, said ribs further including at least one inner rib protruding inward from the interior surface of the band for reinforcing the resiliency of the band and preventing slippage when the arm band is worn and wherein said inner rib is positioned in between said outer ribs.

11. An arm band as recited in claim 10 further comprising a label applied to the exterior of the band between said outer ribs.

12. An arm band comprising:

a substantially cylindrical split ring band having interior and outer surfaces;

a pair of outer rib protruding outward from the exterior surface at opposite sides of the band for reinforcing the resiliency of the band;

at least one inner rib protruding inward from the interior surface of the band for reinforcing the resiliency of the band and preventing slippage when the arm band is worn, the inner rib being positioned intermediate of the outer ribs;

a first lip extending outward from a first end of the band; and a second lip extending outward from a second end of the band, the second lip being shorter than said first lip such that the first lip forms a contact surface helpful in putting the arm band on.

13. An arm band as recited in claim 12 wherein said inner rib has a substantially rectangular cross section having a height substantially less than its width.

14. An arm band as recited in claim 12 wherein said inner rib has a roughened surface to enhance the slide resistance of the arm band.

15. An arm band comprising:

a split ring band having interior and exterior surfaces;

a label applied to the exterior surface of the band; and a foam material interposed between the label and the exterior surface of the band.

16. An arm band as recited in claim 15 wherein the thickness of the foam material is in the range of 1 to 3 millimeters.

17. An arm band as recited in claim 15 wherein the foam material is applied to the exterior surface of the band by an adhesive and the label is applied to the foam material by an adhesive.

18. An arm band as recited in claim 15 wherein opposite ends of the label are directly adhered to the exterior surface of the band.

19. An arm band as recited in claim 15 wherein the band is formed from a foam material having a higher density than the interposed foam material.

20. An arm band comprising:

a substantially cylindrical self-supporting elastic split ring band having interior and outer surfaces and facing first and second ends;

at least one rib for reinforcing the resiliency of the band;

a first lip extending radially outward from the first end of the band; and a second lip extending radially outward from the second end of the band, the second lip being radially shorter than said first lip such that the first lip forms a contact surface helpful in putting the arm band on.

* * * * *